US005934138A

United States Patent [19]

Semien

[11] Patent Number: 5,934,138

[45] Date of Patent: Aug. 10, 1999

[54] TOOL AND METHOD FOR BENDING ANGLE STOCK

[75] Inventor: Paul F. Semien, LaMarque, Tex.

[73] Assignee: Enron Corp., Houston, Tex.

[21] Appl. No.: 09/036,869

[22] Filed: Mar. 9, 1998

[51] Int. Cl.[6] ..... B21D 7/00

[52] U.S. Cl. ..... 72/458; 72/479

[58] Field of Search ..... 72/458, 479, 387, 72/388, 409.01, 324

[56] References Cited

U.S. PATENT DOCUMENTS

| | | | |
|---|---|---|---|
| 4,315,422 | 2/1982 | McBride | 72/458 |
| 4,619,132 | 10/1986 | McBee | 72/458 |
| 4,934,175 | 6/1990 | Hensler et al. | 72/458 |
| 5,564,302 | 10/1996 | Watrous | 72/458 |

FOREIGN PATENT DOCUMENTS

| | | | |
|---|---|---|---|
| 4300316 | 7/1994 | Germany | 72/458 |

OTHER PUBLICATIONS

Sales catalog from Techline Mfg. located in Spanish Fort, AL 36527 entitled "Precision Raceway, Tubing Supports, Instrument Stands, Tubing & Wire Clamps [and] Condensation Chambers" Revised 9–94, 12 pages.

*Primary Examiner*—David Jones

*Attorney, Agent, or Firm*—Akin, Gump, Strauss Hauer & Feld

[57] ABSTRACT

The present invention provides tools and methods for bending angle stock, a tool including first and second parallel facing plates and a third plate holding the first and second plates in a fixed position. The third plate is fixed to upper edges of the first and second plates, and the first and second plates are separated by a gap sized to receive a side of the angle stock. The first plate has a back surface to which is attached an end of a rod-shaped handle. A bend in the angle stock is made by first cutting one side of the angle stock at a desired bend point on the other side and then placing two of the tools on the uncut side, one on each side of the desired bend point. The handles of the tools are pushed together to form a 90° bend in the angle stock, which is formed because the edges of the first plates that are adjacent to the desired bending point have a 45° angle. With this edge, a right-hand tool contributes a 45° bend and a left-hand tool contributes a 45° bend for a total of 90°. The third plate has a surface co-planar with the angled edge of the first plate, and contact between the right-hand and left-hand tools at this surface stops further bending, thus forming a 90° bend. The third plate thus serves as a stop for determining that a 90° bend has been completed, and the first and second plates grip one side of the angle stock.

24 Claims, 4 Drawing Sheets

TOOL AND METHOD FOR BENDING ANGLE STOCK

CROSS-REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

This invention pertains to bending angle stock, and particularly to tools and methods for bending angle stock such as is used for supporting tubing, wires, cable and the like.

2. Description of the Related Art

In industrial and commercial applications, angle stock having standard dimensions such as 2 inch by 2 inch sides is installed to receive, hold and support lines, including pneumatic tubing, electric wires, and fiber optic cable, which are fastened to the angle stock with clips and bolts. Such angle stock is commercially available in lengths ranging typically up to about twenty feet and in a variety of materials of construction including iron, galvanized iron, and aluminum.

As an example of an industrial application, angle stock is installed in a chemical plant, petrochemical plant or refinery for receiving pneumatic instrument tubing or electrical wire used for control of equipment and machinery. The angle stock is supported by stanchions or is attached to pipe racks and the like. It is frequently necessary to run long lengths of angle stock to provide support for various lines, and to do so, it is necessary to make numerous bends in the angle stock.

A bend in angle stock along a desired bend line has been made by first cutting appropriate clearance notches and manually bending one end of the angle stock toward the other end at the desired bending point to form either an "outside" or an "inside" bend. Bending has been accomplished by hand or with the assistance of a vise and hammer. When angle stock is bent by hand without the aid of any tool, the angle stock may not bend to form a clean angle in each side adjacent to the desired bend point.

A clean bend has been obtained by using a vise to squeeze and straighten a side adjacent the bend or by using a vise and hammer to straighten a side adjacent the bend. Although straight sides are not essential for function and performance of the angle stock as a support tray, the neat appearance of a clean bend with straight lines is considered desirable and thus time is typically spent to achieve a neat appearance.

A problem with such bending is that a vise is required, and a vise must be mounted to a support. Angle stock is frequently installed as a field application where use of a vise is not convenient. Although a vise can be mounted on a truck, and the truck can be driven to the work site, the point of installation may be in a pipe rack, for example, which requires numerous trips up and down a ladder between the point of installation and the vise. Further, when working with a twenty-foot piece of angle stock, it is cumbersome to use a vise and hammer to bend the angle stock. In addition to such bending operations not producing crisp bends and straight sides in the angle stock, such manual bending is time-consuming and often requires more than one worker.

Alternatively, fitting angles are commercially available for assembling an angled joint between two straight pieces of angle stock. However, industrial parts such as these are expensive, and it is time consuming to assemble fitting angles. Further, a fitting angle is not as strong as a bent angle, such as described above, because the bent angle is formed in an integral piece of angle stock, while the fitting angle is an assembly of two pieces of angle stock with a fitting in between. Non-integral fitting angles are bolted together, and the bolts have a tendency to work loose over time, which effectively disassembles the fitting angle.

Angle stock installed in industrial applications such as in chemical plants, is subjected to a considerable amount of vibration which tends to work the bolts loose in the fittings. It is not unusual to see missing bolts and loose joints in such applications after a period of time has elapsed since installation. In such instances, the line that was initially supported, such as a pneumatic instrument line, is no longer supported and is consequently subject to failure. Two problems are thus inherent in using prefabricated fitting angles—the fittings are expensive and they work loose, leaving the line secured to the angle stock unsupported. On the other hand manual bending of angle stock to form a clean, crisp bend requires a vise and hammer, which is inconvenient and cumbersome to use.

SUMMARY OF THE INVENTION

The present invention provides a tool assembly and method for forming integral bends in angle stock quickly, easily, conveniently and inexpensively. The tool assembly includes first and second tool members, each having a bending recess for receiving a side of the angle stock, and each having an extended handle portion to allow a user to exert leverage through the tool members to form a bend in the angle stock.

To bend the angle stock, one side of the angle stock is cut at a desired bend point in the uncut side, one cut for an outside bend and two cuts removing a V-shaped notch for an inside bend. The first tool member is placed on the uncut side to the right of the desired bend point, and the second tool member is placed on the uncut side to the left of the desired bend point, each tool member receiving the uncut side in its bending recess. Force is exerted on the handle portions of the tool members to form a bend in the uncut side between the tool members.

A spacer tool having a stabilizing recess is further provided for use in making long-radius bends in the angle stock. For long-radius bends, at least two cuts are made in a side of the angle stock, the space between the cuts determining the radius of the bend. The spacer tool is positioned on the uncut side between the cuts with the uncut side received in the stabilizing recess. The first tool member is placed on the uncut side to the right of the spacer tool, and force is exerted on the spacer tool and the first tool member to form a bend in the uncut side between the spacer tool and the first tool member. The second tool member is then placed on the uncut side to the left of the spacer tool, and force is exerted on the spacer tool and the second tool member to form a bend in the uncut side between the spacer tool and the second tool member.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF INVENTION

Figure 1:
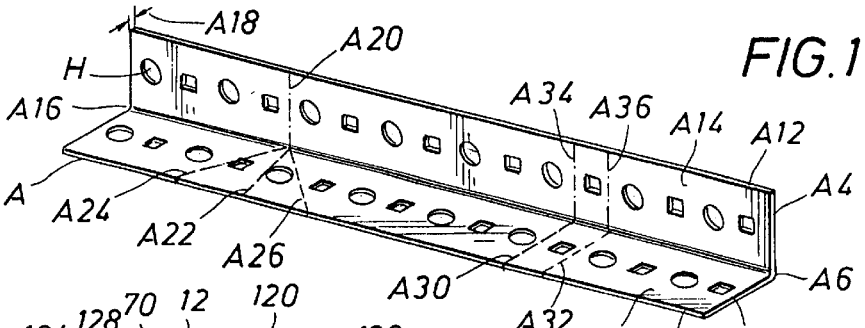
FIG. 1 is a perspective view of a typical section of angle stock.

With reference to FIG. 1, a longitudinal section of angle stock A is shown in a perspective view. Angle stock A has a first side A2 and a second side A4 integrally joined at a right angle along a bond line A6. First side A2 has an outside edge A8 and an inside surface A10. Second side A4 has an outside edge A12 and an inside surface A14, and an interior space A16 is defined generally between inside surface A10 and inside surface A14. Angle stock A has a thickness A18 and a plurality of holes H of various shapes, which are provided for attaching angle stock A to a support or for attaching a line that is to be supported by angle stock A.

With reference to FIGS. 2–5, a tool 10 having a bending head 12 and a handle 14 is shown according to the present invention. Head 12 includes a first element F, a second element S spaced apart from first element F and forming a bending gap, notch or recess G and a third element T holding the first and second elements in a fixed relationship. First element F is a rectangular bending plate 20 having an interior planar surface 22 facing second element S. Plate 20 has a back surface 24 on a side opposite planar surface 22 and is parallel to planar surface 22. Handle 14 is secured to back surface 24 at a 45° angle, such by welding, as indicated by a welding bead 26. Alternatively, a receptacle, such as a threaded fitting, can be secured to back surface 24 for receiving a handle.

Bending plate 20 has an angled first edge 30, which has a surface 32. First edge 30 is formed at a 45° angle to planar surface 22 as measured through bending plate 20. The 45° angle on first edge 30 contributes 45° toward a 90° bend, as is described further below. Surface 32 of first edge 30 is parallel to a longitudinal axis (not shown) of handle 14 so that the handle will be properly positioned for a bending motion.

Figure 4:
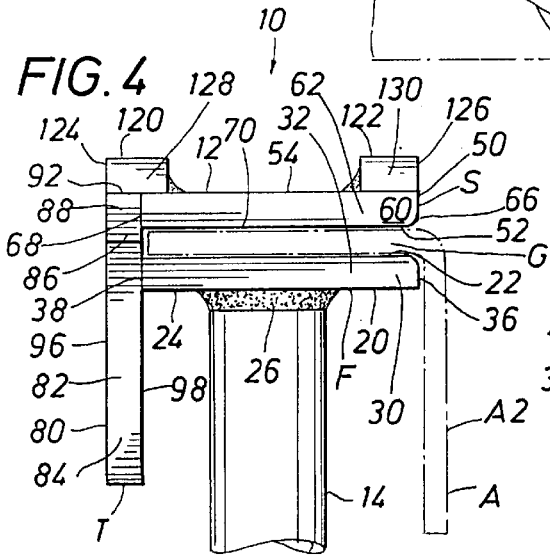
FIG. 4 is a side view of the tool bending head of FIG. 3, as seen along the lines 4—4.
Figure 5:
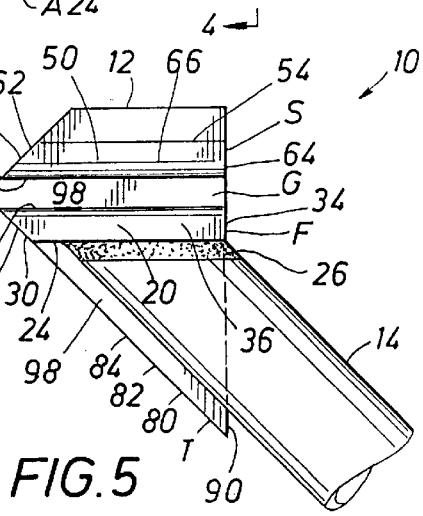
FIG. 5 is a bottom view of the tool bending head of FIG. 3.

Bending plate 20 is generally square or rectangular and has a second edge 34 opposite first edge 30. Bending plate 20 has a bottom edge 36 and an opposing top edge 38 (FIG. 4). Top edge 38 may be integrally formed with third element T or it may be secured to third element T such as by welding. Top and bottom edges 38 and 36, respectively, are generally parallel with each other and generally perpendicular to first and second edges 30 and 34, respectively. Surface 32 of first edge 30 intersects planar surface 22 and forms a straight bending edge 40.

Second element S is a bending plate 50 having an interior planar surface 52 facing and spaced from planar surface 22 of bending plate 20 to form the bending notch or recess G. Bending plate 50 has a shape similar to and symmetrical to bending plate 20 and thus can be described in the same terms. Bending plate 50 has a back surface 54 on an opposite side of plate 50 from planar surface 52. Bending plate 50 has an angled first edge 60, which has a surface 62. First edge 60 is formed at a 45° angle to planar surface 52 as measured through bending plate 50.

Bending plate 50 is generally square or rectangular and has a second edge 64 opposite first edge 60. Plate 50 has a bottom edge 66 and an opposing top edge 68. Top and bottom edges 68 and 66, respectively, are generally parallel with each other and generally perpendicular to first and second edges 60 and 64, respectively. Surface 62 of first edge 60 intersects planar surface 52 and forms a straight line or straight edge 70.

Third element T is a guide plate 80 attached to or formed integral with first element F and second element S for holding first element F and second element S in a fixed relationship to form the bending recess G. Guide plate 80 has a first edge 82 aligned with first edge 30 of plate 20. First edge 82 has a surface 84, which is co-planar with surface 32 of first edge 30 of bending plate 20.

Guide plate 80 has a second edge 86 adjacent to and at a right angle to first edge 82. Second edge 86 has a surface 88, and surface 88 is co-planar with surface 62 of first edge 60 of plate 50. Plate 80 has a third edge 90 intersecting first edge 82 and a fourth edge 92 intersecting third edge 90 and second edge 86. Fourth edge 92 is co-planar with back surface 54 of plate 50. Surface 88 on second edge 86 forms a right angle with surface 84 of first edge 82. Surface 88 is co-planar with surface 62 of first edge 60 of plate 50, and surface 84 is co-planar with surface 32 of first edge 30 of plate 20. The angle between surface 88 and surface 84 is a right angle, and thus, it follows that a line between straight edge 40 and straight edge 70 is at a right angle to planar surface 22 and planar surface 52.

Guide plate 80 has a top surface 96 and a bottom surface 98. Planar surfaces 22 and 52 of plates 20 and 50, respectively, intersect bottom surface 98 at right angles. Further, the distance between planar surface 22 and planar surface 52 of plates 20 and 50, respectively, is uniform throughout, and thus, gap G is uniform throughout the space defined by planar surface 22, planar surface 52 and bottom surface 98. Gap G has a width, which is the distance between planar surface 22 and planar surface 52, slightly larger than the thickness A18 of angle stock A, which is shown in phantom lines, so that side A4 can be received in gap G for using tool 10 to bend angle stock A. The gap G must be sufficiently wide to easily receive side A4 of angle stock A, but yet sufficiently tight fitting so that a 90° angle can be formed, as explained further below.

The use of tool 10 is illustrated with reference to FIGS. 6–10. A right-hand tool 10R and a left-hand tool 10L are mirror images of each other and equivalent to tool 10 described above. The suffix L or R will be used where necessary with numbers and letters generally used to identify tool 10, but omitted where a distinction between right and left is unnecessary. Where the suffix is omitted, it is understood that the characteristic or feature described applies equally to right-hand tool 10R or to left-hand tool 10L.

Figure 6:
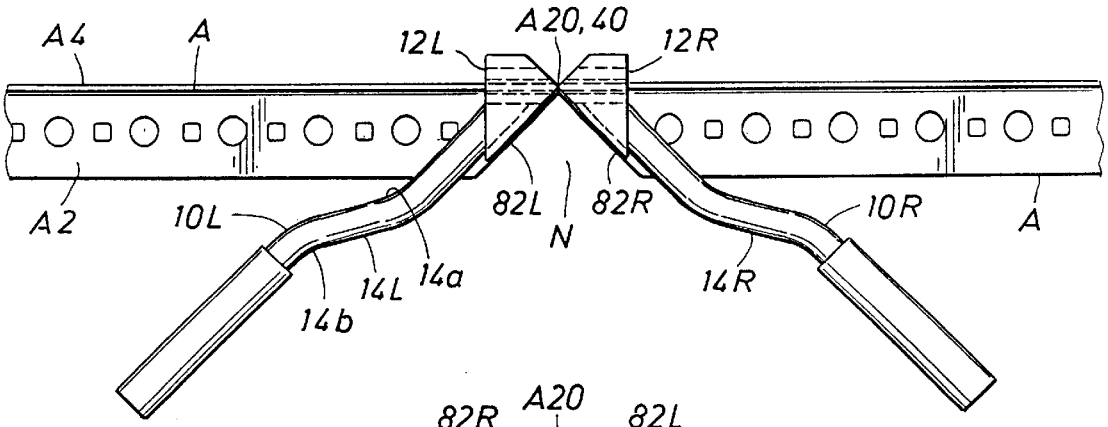
FIG. 6 is a plan view of a left-hand tool and a right-hand tool placed on angle stock prior to making an inside bend, according to the present invention.
Figure 7:
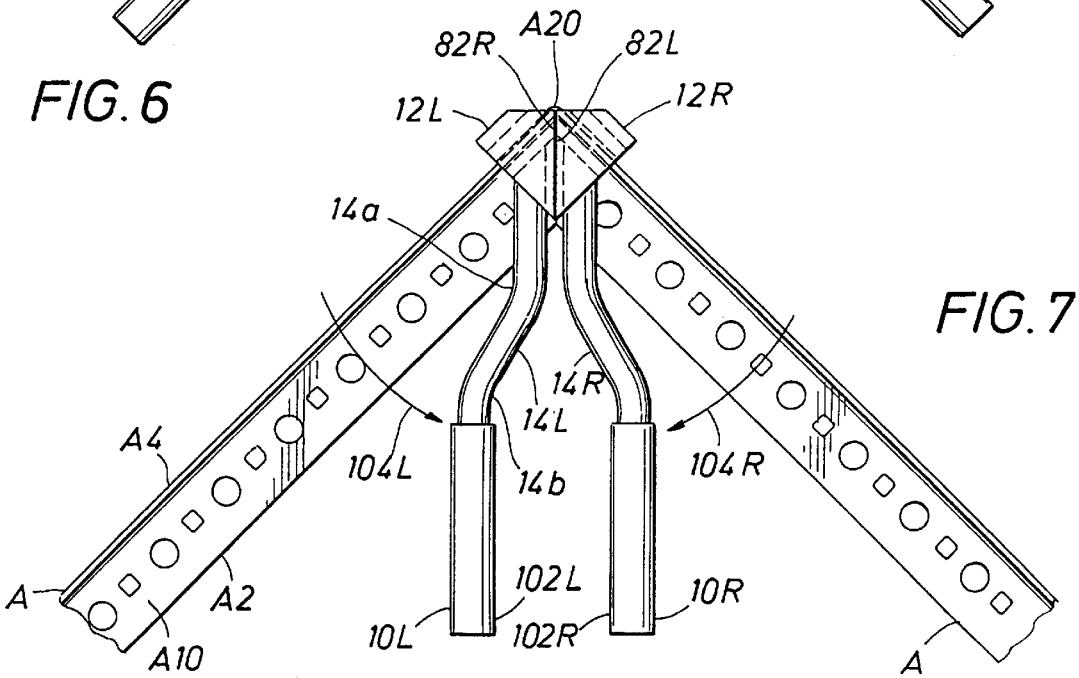
FIG. 7 is a plan view of the left-hand and right-hand tools of FIG. 6 after an inside bend on the angle stock has been made.
Figure 8:
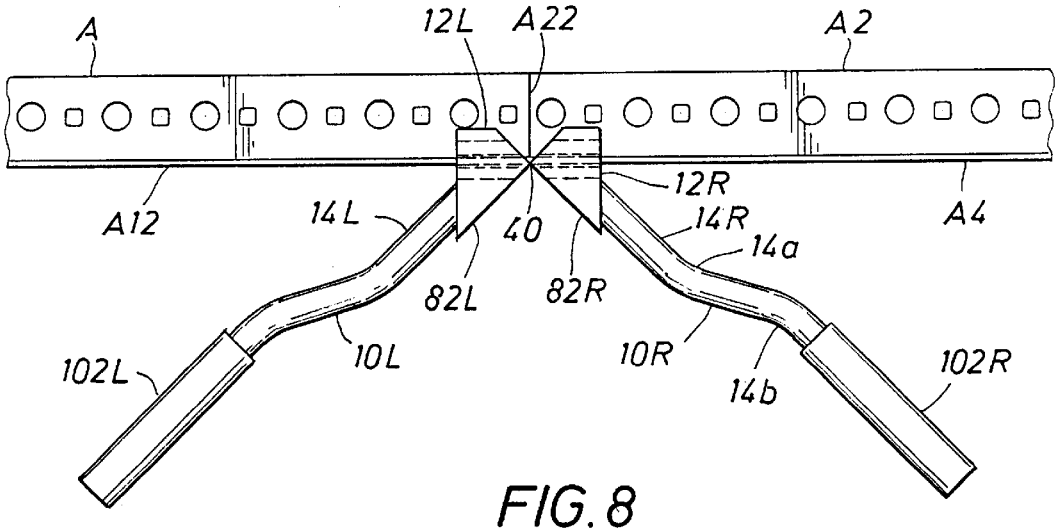
FIG. 8 is a plan view of a left-hand tool and a right-hand tool placed on angle stock prior to making an outside bend, according to the present invention.
Figure 9:
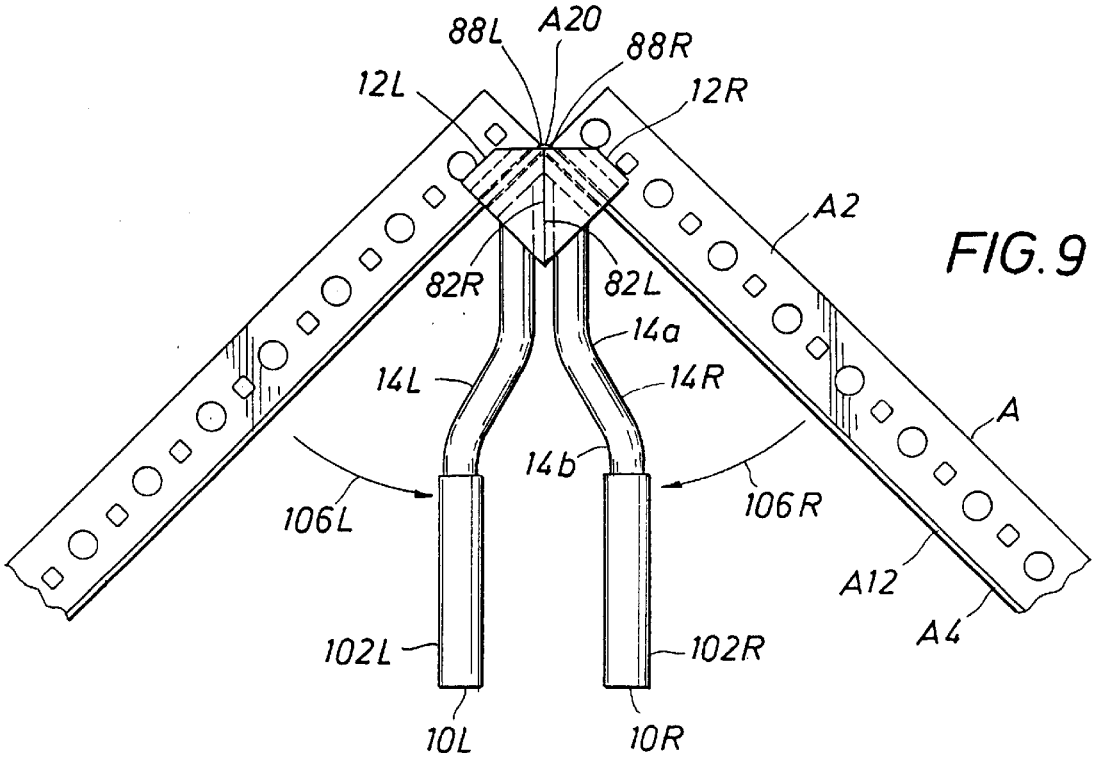
FIG. 9 is a plan view of the left-hand and right-hand tools of FIG. 8 after an outside bend on the angle stock has been made.

An inside 90° bend is formed in angle stock A by first cutting along the lines A24 and A26 to form a notch N in side A2 (FIG. 6). Right-hand tool 10R is engaged with angle stock A by placing head 12R over side A4 so that side A4 is within gap G and handle 14R is toward interior space A16. Straight edge 40R is placed to the immediate right of desired bend line A20, as viewed in FIG. 6. Side A4 is fully engaged in the space defined by planar surface 22R, planar surface 52R and bottom surface 98R. Bottom surface 98R of plate 80R rests on edge A12 of side A4. The dimensions of plates 20R and 50R are such that edges 36R and 66R, respectively, are proximate to line A6 of angle stock A. Thus, when tool 10R is engaged with angle stock A, bottom edge 36R of plate 20R is relatively close to surface A10 of side A2 so that a clean bend can be made along the full length of the line A20.

Similarly, left-hand tool 10L is engaged with angle stock A to the immediate left of desired bend line A20. Side A4 is received in head 12L within gap G. Again, bottom surface 98 of plate 80 rests on edge A12 of side A4. A straight edge 40L, which equivalent to straight edge 40, is aligned to the immediate left of desired bending line A20. Grips 102R and 102L on right-hand tool 10R and left-hand tool 10L, respectively, are grasped by a user and pulled together as indicated by arrows 104R and 104L in FIG. 7. Grips 102R and 102L are brought towards each other until stopped by contact between first edges 82R and 82L, which serve as stops.

When further movement is stopped by contact between first edges 82R and 82L, a 90° inside bend is formed in angle stock A. A 90° angle is formed because a 45° angle is provided between first edge 30 and planar surface 22. Right-hand tool 10R and left-hand tool 10L each contribute 45°, and two adjacent 45° angles create a 90° angle. A 90° angle is formed provided gap G is approximately equal to the thickness A18 of side A4. During the bending motion, side A4 bears against planar surface 22 adjacent to first edge 30 and against planar surface 52 adjacent to second edge 64. Thus, if gap G is too wide, a 90° angle will not be formed when further movement is stopped by contact between first edge 82R and first edge 82L.

An outside 90° bend (FIGS. 8–10) is formed by first cutting angle stock A along the line A22, which is perpendicular to side A4 and aligned with desired bending line A20. Right-hand tool 10R is placed on angle stock A such that side A4 is received in gap G of head 12R. Straight edge 40R is placed to the immediate right of desired bending line A20, as viewed in FIG. 8, with handle 14R directed away from interior space A16. Left-hand tool 10L is placed over second side A4 in a similar fashion and straight edge 40L is aligned immediately to the left of desired bending line A20. With tools 10R and 10L thus placed on the outside of angle stock A, force is exerted on handles 14R and 14L by grasping grips 102R and 102L and forcing them together as indicated by the arrows 106R and 106L in FIG. 9.

Handle 14 is attached to back surface 24 at a 45° angle so that handles 14R and 14L do not collide during this bending motion. Even with this 45° mounting of the handle, the user's fingers would be squeezed between grips 102R and 102L if handle 14 were straight. To prevent this, two 45° bends 14*a* and 14*b* provide an offset in handle 14 to provide separation between grips 102R and 102L upon completion of a bend.

Handles 102R and 102L are brought together until stopped by contact between first edges 82R and 82L, which forms a 90° outside bend in angle stock A. The 90° outside bend is formed because the angle formed between surface 32 of first edge 30 and planar surface 22 is a 45°, and the sum of two 45° angles, one for right-hand tool 10R and one for left-hand tool 10L, is 90°. Provided that gap G is only slightly larger than the thickness A18 of side A4, a nearly perfect 90° bend is formed at the desired bend line A20.

These bends are made simply, accurately, and neatly with tools 10R and 10L of the present invention. Tools 10R and 10L are much easier to use than is a vise and a hammer as has been done in the past. The bends that are formed are cleaner and sharper than were bends formed in the past by hand and are more conveniently formed than by using a vise and hammer. The bends formed by the present invention are integral since side A4 is integral, although side A2 has been cut. This is an advantage over prior art fittings in which the angle stock is not integral. Prior art 90° fittings joined two discrete pieces of angle stock. The fittings were bolted into holes H to fasten the two discrete pieces of angle stock together. Unfortunately, the bolts frequently worked loose so that the two discrete pieces of angle stock were no longer firmly connected together. This left the line, such as pneumatic tubing, unsupported. This problem is avoided with the present invention because side A2 is continuous and thus angle stock A is integral when bent according to the methods of the present invention using the tools of the present invention.

Figure 10:
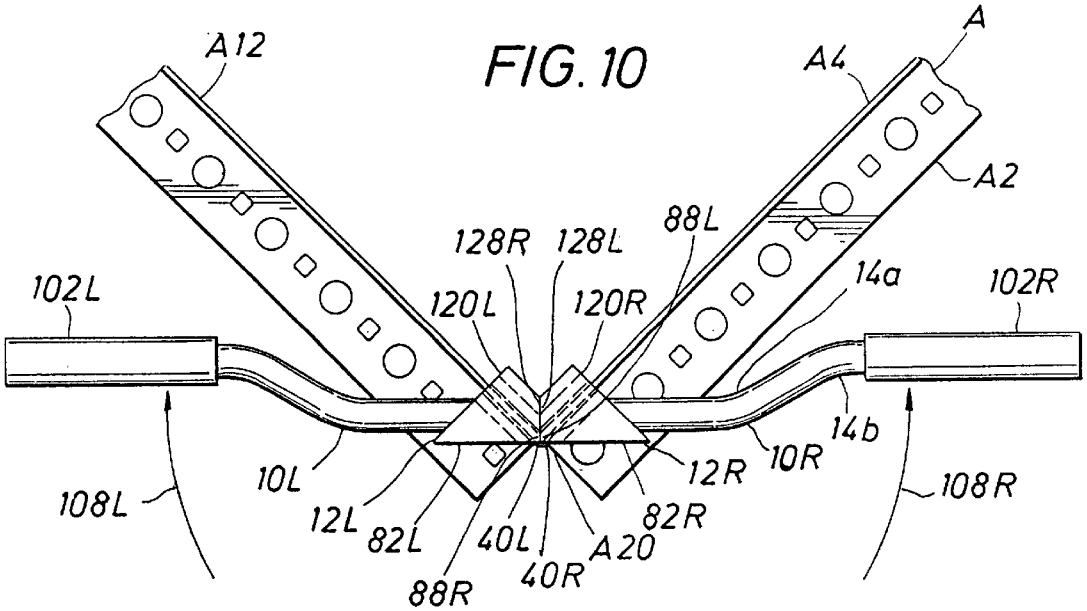
FIG. 10 is a plan view of a left-hand tool and a right-hand tool placed on angle stock after making an outside bend in an alternative manner, according to the present invention.

Turning now to FIG. 10, an alternative method for making an outside bend is illustrated. This alternative method is useful when, for example, space does not allow movement of angle stock A in its usual direction for the methods described above. Tools 10R and 10L are placed over side A4 with handles 14 R and 14L extending into interior space A16, as was done for the inside bend illustrated in FIGS. 6 and 7. However, rather than pulling handles 14R and 14L towards each other, they are instead pushed away from each other as indicated by arrows 108R and 108L in FIG. 10. Force is exerted until surface 88R of second edge 86R contacts surface 88L of second edge 86L. Simultaneously, surface 62R of first edge 60R of plate 50R contacts surface 62L of first edge 60L of plate 50L, since surface 88 is co-planar with surface 62.

Surface 62R of first edge 60R of plate 50R forms a 45° angle with planar surface 52R through plate 50R, and surface 62L of first edge 60L of plate 50L forms a 45° angle with planar surface 52L through plate 50L. Thus, a 90° bend is formed because the sum of two 45° angles yields a 90° angle, one 45° angle being provided by right-hand tool 10R and the other 45° angle being provided by left-hand tool 10L. It is for this alternative bending method that first edge 60 is formed at a 45° angle with respect to planar surface 52 as this angle is not needed, or even useful, for the bends described above.

Figure 2:
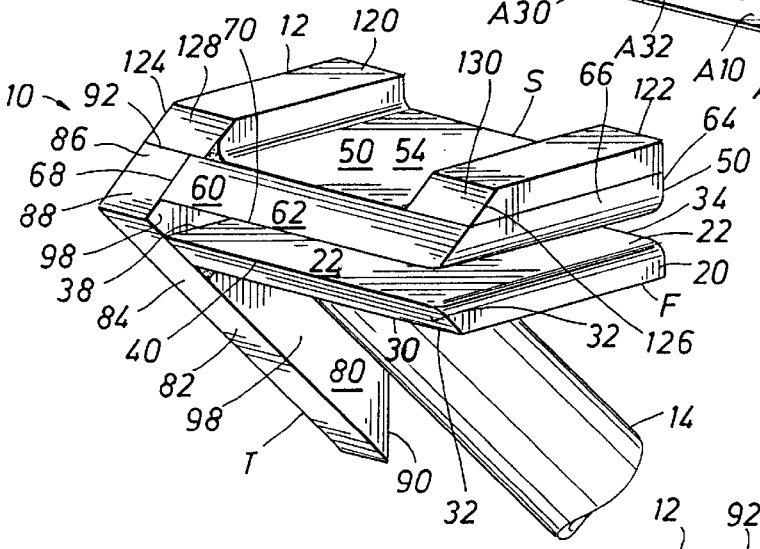
FIG. 2 is a perspective view of the bending head of a tool according to the present invention.
Figure 3:
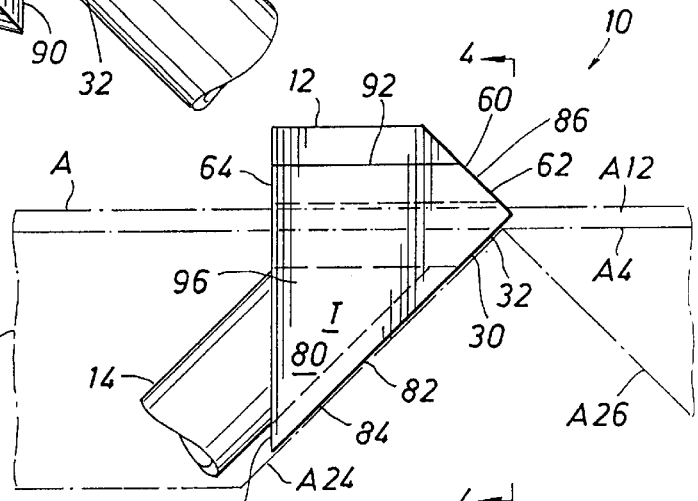
FIG. 3 is a top view of the tool bending head of FIG. 2.

Further bending is prevented by contact between surfaces 88L and 88R. These surfaces provide relatively little surface area for engagement compared to surfaces 84R and 84L on edges 82R and 82L, respectively. With reference to FIGS. 2 and 4, additional surface area for engagement is provided by stops 120 and 122, which have edges 124 and 126, respectively. Edges 124 and 126 have surfaces 128 and 130, respectively, which are co-planar with surface 88 of plate 80 and surface 62 of plate 50. Stops 120 and 122 extend the contact surface of engagement when tools 10R and 10L complete a bend in the manner illustrated in FIG. 10. Thus, stops 120 and 122 are desirable additional features that are useful for stopping further rotation of handles 14R and 14L when used in this alternative manner so that a nearly perfect 90° bend is formed.

The tools and methods described thus far provide short-radius 90° bends. However, on occasion it is desirable to have a long-radius bend. Long-radius bends are used, for example, when making angle stock supports for pneumatic tubing having a diameter of greater than about three-eighths of an inch. Such larger diameter tubing, wires, cable and the like cannot be bent sharply, and thus, a long-radius bend is required for accommodating bends in such lines. Long-radius bends are made in angle stock A, when the bend is an outside 90°, by cutting side A2 at line A30 and making a second cut at a line A32, which is parallel to and spaced from line A30 (FIG. 1). A cut at line A30 allows a bend at a line A34, and a cut at line A32 allows a bend at a line A36. The spacing between the cuts, between lines A30 and A32, is about 1 inch for about three-eighths inch tubing on 2×2 angle stock, where 2×2 means the length of side A2 is 2 inches between line A6 and edge A8, and the length of side A4 is 2 inches between line A6 and edge A12.

Figure 11:
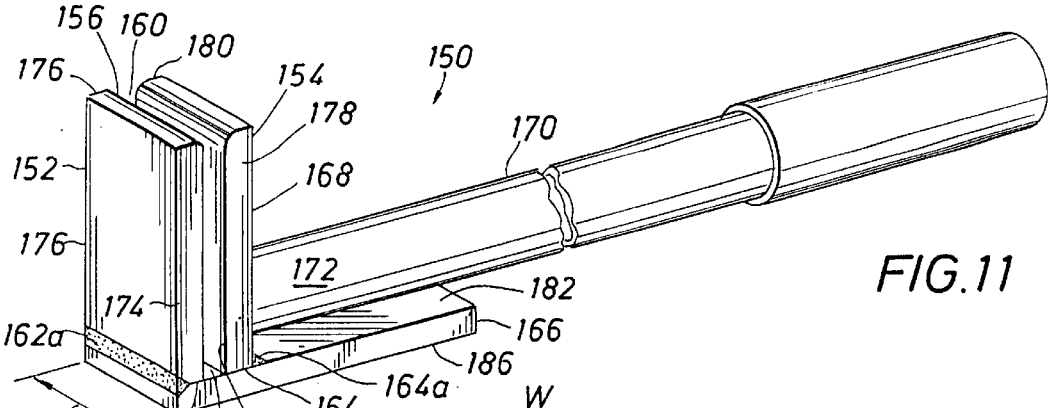
FIG. 11 is a perspective view of a spacer tool for use in making a long-radius bend, according to the present invention.
Figure 12:
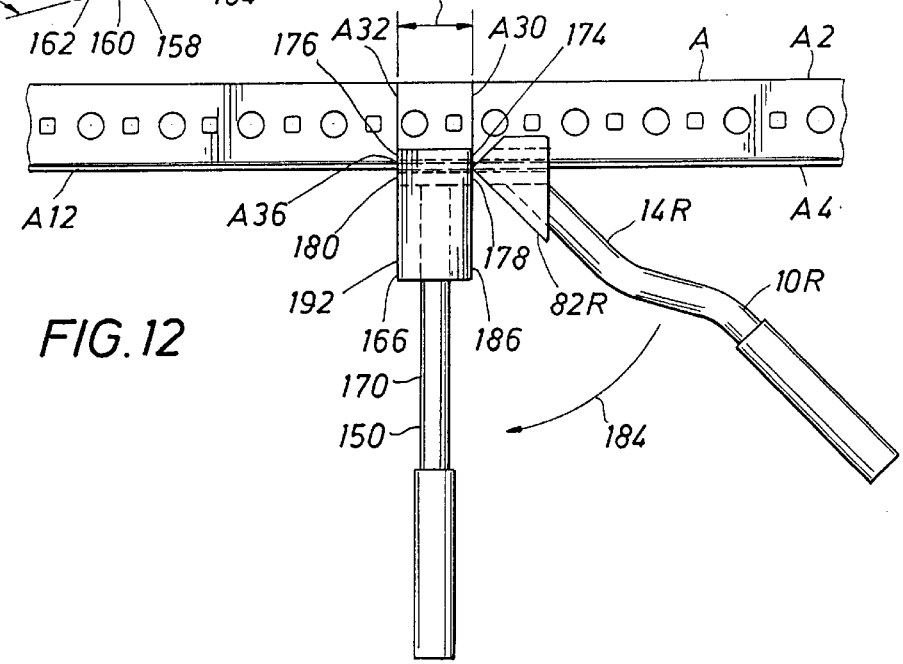
FIG. 12 is a plan view of the spacer tool and the right-hand tool placed on angle stock before making a long-radius bend, according to the present invention.
Figure 13:
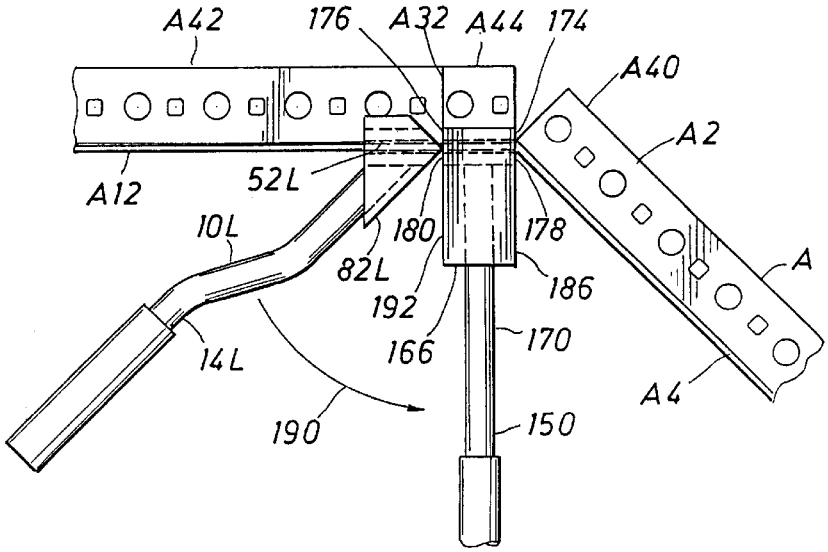
FIG. 13 is a plan view of the spacer tool and the left-hand tool placed on angle stock before making a long-radius bend.

These bends can be made according to the present invention using a spacer tool 150 as shown in FIG. 11. Spacer tool 150 is used to hold side A4 while a 45° bend is made on each side of spacer tool 150, as shown in FIGS. 12 and 13. Spacer tool 150 has an outer plate 152 and an inner plate 154 which faces outer plate 152. Outer plate 152 has a planar surface 156 facing a planar surface 158 on inner plate 154. Planar surface 156 is separated from planar surface 158 by a gap 160, which is only slightly greater than the thickness A18 of angle stock A and about the same width as gap G in tool 10. Outer plate 152 and inner plate 154 have a common width W, which should be the same as the spacing between lines A34 and A36 on side A4, and width W is typically about 1 inch. Outer plate 152 and inner plate 154 have edges 162 and 164, respectively, and a plate 166 is joined to edges 162 and 164 by welding beads 162*a* and 164*a*, respectively.

Outer plate 152 is thus fixedly spaced by gap 160 from inner plate 154, and plates 152 and 154 are perpendicular to plate 166. Inner plate 154 has a back surface 168, and a handle 170 having an end 172 is secured to back surface 168 by welding end 172 to back surface 168. Outer plate 152 and inner plate 154 are essentially identical. Outer plate 152 has side edges 174 and 176 while inner plate 154 has side edges 178 and 180. The width W measures the distance between side edges 174 and 176 and between side edges 178 and 180.

Spacer tool 150 is used in conjunction with tool 10 to make a long-radius bend as illustrated in FIGS. 12 and 13. First, a 45° bend is made between spacer tool 150 and right-hand tool 10R. Spacer tool 150 is placed over side A4 of angle stock A between lines A34 and A36. Edges 174 and 178 are placed to the immediate left of cut line A30 and bend line A34 as viewed in FIG. 12. Side A4 is received in gap 160 of spacer tool 150, edge A12 contacting an inner surface 182 of plate 166. Right-hand tool 10R is placed to the immediate right of bend line A34, and while holding handle 170 stationary, handle 14R is moved toward handle 170 as indicated by arrow 184. Force is exerted on handles 170 and 14R until edge 82R contacts an edge 186 of plate 166. A 45° bend is formed in side A4 when edge 82R is in contact with edge 186.

Right-hand tool 10R is then removed, and left-hand tool 10L is placed on angle stock A, as illustrated in FIG. 13. Edges 176 and 180 of spacer tool 150 are aligned to the immediate right of desired bending line A36, and left-hand tool 10L is placed to the immediate left of line A36, as viewed in FIG. 13. Spacer tool 150 is held in the user's right hand and held stationary. Handle 141, on tool 10L is pushed toward handle 170 of spacer tool 150, as indicated by arrow 190, thus bending side A4 of angle stock A. Bending stops when edge 82L contacts an edge 192 of plate 166 on spacer tool 150, which forms a 45° angle between planar surface 52L on tool 10L and edge 192 on spacer tool 150 because planar surface 52L is placed at a 45° angle with respect to edge 82L.

Upon completion of this bend, angle stock A has three sections, a right section A40 to the right of cut line A30, a left section A42 to the left of cut line A32, and a spacer section A44 in between sections A40 and A42. When bent, a 45° angle is formed between right section A40 and spacer section A44, and a 45° angle is formed between left section A42 and spacer section A44. Thus, a 90° bend is formed between right section A40 and left section A42, but spacer section A44 provides a longer radius to be formed than if a single cut line were used. This longer-radius bend can better accommodate a larger diameter line supported by angle stock A than can a shorter-radius bend formed using a single cut line.

Thus, spacer tool 150 is a convenient tool for holding spacer section A44 between bend lines A34 and A36, while tool 10 is used to make two 45° bends in angle stock A. Prior methods did not offer a convenient way for holding angle stock A while making a long-radius bend. Long-radius inside bends can be made by properly notching side A2 and placing spacer tool 150 inside of angle stock A with handle 170 in interior space A16. Right-hand tool 10R is placed on the inside of angle stock A, and a 45° angle is bent between spacer tool 150 and right-hand tool 10R. Similarly, an inside 45° bend is made using left-hand tool 10L and spacer tool 150, forming a long-radius inside bend.

In summary, bends can be conveniently and easily made in angle stock A using tool 10 and, where a long-radius bend is required, spacer tool 150. Tools 10R and 10L and spacer tool 150 are relatively small and light and can thus be carried by a person installing angle stock A. Trips between a work site and a vise are thus eliminated, which improves the productivity of the person installing the angle stock. Productivity is further improved because angles can be bent more quickly with tools 10R and 10L and spacer tool 150 than with a vise and a hammer. Considerable time is required to insert angle stock A in a vise, tighten the vise and bend the angle stock or pound with a hammer, but little time is required to make a bend using tool 10.

When compared to using angled fittings to make bends, use of tools 10R and 10L and spacer tool 150 is much less expensive and faster. Thus, the economic productivity of the installer is improved. Further, an installation using the methods of the present invention is superior to an installation using purchased fittings because the methods of the present invention provides an integral bend. Side A4 is continuous and is thus integral since it has not been cut. In installations using fittings and bolts, the bolts frequently work loose due to vibrations, thus disassembling the bend. This leaves the line, the tubing or cable, installed in the angle stock unsupported, which can lead to failure of the line. In installations according to the present invention, the line is never left unsupported because the bends are integral since a continuous section of angle stock is used to fabricate the bend. The tools and methods of the present invention thus provide a stronger and more durable installation of angle stock having bends, and the installation can be completed more quickly than has been accomplished in the past and with less expense.

The foregoing disclosure and description of the invention are illustrative and explanatory thereof, and various changes in the details of the illustrated apparatus and construction and method of operation may be made without departing from the spirit of the invention.

I claim:

1. A tool assembly for bending angle stock comprising first and second tool members, each tool member having a bending head with first and second elements providing a bending recess therebetween for receiving the angle stock and having an extended handle attached to the first element for applying leverage through the tool member to form a bend in the angle stock.

2. The tool assembly of claim 1, wherein the first element of each tool member has a bending edge.

3. The tool assembly of claim 2, wherein the second element of each tool member has a bending edge providing an angled face adjacent the bending recess.

4. The tool assembly of claim 2, wherein each tool member has a stopping element attached to the first element for determining an angle of a bend in the angle stock.

5. A tool for use in bending angle stock, comprising:

a first element having a planar surface and a bending edge having a thickness and a bending edge surface;

a second element facing the planar surface of the first element, the second element being separated from the planar surface of the first element by a gap; and a third element fixed to the first and second elements, the third element having a stopping edge, the stopping edge having a stopping edge surface, wherein the stopping edge surface of the stopping edge of the third element is co-planar with the bending edge surface of the bending edge of the first element, and wherein the stopping edge of the third element has a length greater than the thickness of the bending edge of the first element.

6. The tool of claim 5, further comprising a handle attached to the first element, the handle having a longitudinal axis, wherein the longitudinal axis of the handle is parallel to a plane lying on the edge surface of the bending edge of the first element.

7. The tool of claim 5, wherein an angle of about 45° is formed at the intersection of the planar surface and the bending edge surface of the bending edge of the first element, the angle being measured through the first element.

8. The tool of claim 5, wherein the first element is a plate, further comprising a handle attached to the first element.

9. The tool of claim 8, wherein the third element is a plate, further comprising a stop attached to the second element.

10. The tool of claim 5, wherein the second element has a planar surface and a bending edge, the bending edge having a bending edge surface, wherein an angle of about 45° is formed at the intersection of the planar surface of the second element and the bending edge surface of the bending edge of the second element, the angle being measured through the second element.

11. The tool of claim 10, wherein the planar surface of the first element faces the planar surface of the second element and the first and second elements each have a top edge, wherein the third element is fixed to the top edge of the first element and to the top edge of the second element.

12. A tool for use in bending angle stock, comprising:

a first element having a planar surface and a first edge having an edge surface;

a second element facing the planar surface of the first element, the second element being separated from the planar surface of the first element by a gap; and a third element fixed to the first and second elements, the third element having a first edge, the first edge having an edge surface, wherein the edge surface of the first edge of the third element is co-planar with the edge surface of the first edge of the first element, the first element having a back surface opposing the planar surface of the first element; and a handle attached to the back surface.

13. The tool of claim 12, wherein the handle is an elongated rod having a longitudinal axis and opposing ends and one end is attached, an angle of about 45° being formed between the longitudinal axis and the planar surface of the first element.

14. A device for bending angle stock, comprising:

first and second plates each having a planar internal surface, the planar internal surfaces facing each other and being separated by a gap in order to form a bending recess, the first and second plates each having an attachment edge and a bending edge; and a third plate fastened to the attachment edges of the first and second plates for holding the first and second plates in a fixed relationship to cooperate with the planar surfaces of the first and second plates to form the bending recess, the third plate having a stopping edge co-planar with the bending edge of the first plate, the bending edge of the first plate forming an angle of about 45° with the planar surface of the first plate, the stopping edge of the third plate extending at about a right angle from the planar internal surfaces.

15. The device of claim 14, wherein the third plate has a second edge co-planar with the bending edge of the second plate.

16. The device of claim 15, wherein the stopping and second edges of the third plate intersect at a right angle.

17. The device of claim 14, wherein the first and second plates are each square or rectangular in shape, the third plate has a second edge co-planar with the bending edge of the second plate, and the stopping and second edges of the third plate intersect and form a right angle, further comprising a handle attached to the first plate and extending parallel to the stopping edge of the third plate.

18. A device for bending angle stock, comprising:

first and second plates each having a planar surface, the planar surfaces facing each other and being separated by a gap, the first and second plates each having an upper edge and a first edge, the first plate having a back surface;

a third plate fastened to the upper edges of the first and second plates for holding the first and second plates in a fixed relationship, the third plate having a first edge co-planar with the first edge of the first plate, the first edge of the first plate forming an angle of about 45° with the planar surface of the first plate; and a handle secured to the back surface.

19. The device of claim 18, wherein the handle is an elongated rod having an end and a longitudinal axis, and the end is secured to the back surface so that an angle of about 45° is formed between the longitudinal axis and the planar surface of the first plate.

20. A device for bending angle stock, comprising:

first and second plates each having a planar surface, the planar surfaces facing each other and being separated by a gap, the first and second plates each having an upper edge and a first edge; and a third plate fastened to the upper edges of the first and second plates for holding the first and second plates in a fixed relationship, the third plate having a first edge co-planar with the first edge of the first plate, the first edge of the first plate forming an angle of about 45° with the planar surface of the first plate, wherein a plane lying on the first edge of the first plate intersects a plane lying on the first edge of the second plate and forms an angle of approximately 90°.

21. A method for bending angle stock, angle stock being a longitudinal section of structural material rolled longitudinally into an L-shape having first and second sides, the method comprising the steps of:

cutting the first side of the angle stock at a point where a bend is desired;

providing first and second tool members, each having a bending recess;

positioning the first tool member on the second side to the right of the point where a bend is desired, the second side being received in the bending recess of the first tool member;

positioning the second tool member on the second side to the left of the point where a bend is desired, the second side being received in the bending recess of the second tool member;

leveraging the first and second tool members to apply a bending force to the angle stock; and forming a bend in the second side of the angle stock between the first and second tool members.

22. The method of claim 21, wherein the first and second tool members each have a stopping mechanism, further comprising determining a bending angle by contact of the stopping mechanism of the first tool member with the stopping mechanism of the second tool member.

23. The method of claim 22, wherein the first and second tool members each comprise:

first and second plates each having a planar surface, the planar surfaces facing each other and being separated by a gap, the first and second plates each having an upper edge and a first edge;

a third plate fastened to the upper edges of the first and second plates for holding the first and second plates in a fixed relationship, the third plate having a first edge co-planar with the first edge of the first plate, the first edge of the first plate forming an angle of about 45° with the planar surface of the first plate, the first edge of the third plate extending perpendicularly from the planar surfaces for providing the stop mechanism; and a handle attached to the first plate.

24. A method for making a long-radius bend in angle stock, angle stock being a longitudinal section of structural material rolled longitudinally into an L-shape having first and second sides, the method comprising the steps of:

making first and second cuts in the first side of the angle stock for determining the desired location of a bend in the second side, the second cut being spaced apart from the first cut;

providing first and second tool members, each having a bending recess;

providing a spacer tool member having a stabilizing recess;

positioning the first tool member on the second side to the right of the desired location of a bend, the second side being received in the bending recess of the first tool member;

positioning the spacer tool member on the second side between the first and second cuts, the second side being received in the stabilizing recess of the spacer tool member;

bending the second side of the angle stock between the first tool and spacer tool members by applying force to the first tool and spacer tool members;

positioning the second tool member on the second side to the left of the desired location of a bend, the second side being received in the bending recess of the second tool member; and bending the second side of the angle stock between the second tool and spacer tool members by applying force to the first tool and spacer tool members.

* * * * *